US008863467B1

(12) United States Patent
Steinberg

(10) Patent No.: US 8,863,467 B1
(45) Date of Patent: Oct. 21, 2014

(54) SYSTEM AND METHOD FOR FREE STANDING PREFABRICATED GLUED LAMINATED MODULAR TIMBER FRAME MEMBERS

(71) Applicant: Dov Steinberg, Olesh (IL)

(72) Inventor: Dov Steinberg, Olesh (IL)

( * ) Notice: Subject to any disclaimer, the term of this patent is extended or adjusted under 35 U.S.C. 154(b) by 0 days.

(21) Appl. No.: 14/085,823

(22) Filed: Nov. 21, 2013

(51) Int. Cl.
*E04H 12/00* (2006.01)
*E04B 1/19* (2006.01)

(52) U.S. Cl.
CPC ..... *E04B 1/19* (2013.01)
USPC ..... 52/653.1

(58) Field of Classification Search
USPC ..... 52/653.1, 847, 656.1, 656.2
See application file for complete search history.

(56) References Cited

U.S. PATENT DOCUMENTS

| | | | | | |
|---|---|---|---|---|---|
| 3,106,752 | A * | 10/1963 | Hannen | 52/843 |
| 3,161,267 | A * | 12/1964 | Keller | 428/120 |
| 3,445,325 | A * | 5/1969 | Clark | 428/119 |
| 4,677,806 | A * | 7/1987 | Tuomi | 52/656.1 |
| 6,050,047 | A * | 4/2000 | Covelli et al. | 52/847 |
| 6,051,301 | A * | 4/2000 | Tingley | 428/106 |
| 6,357,195 | B1 * | 3/2002 | Chen | 52/668 |
| 6,446,412 | B2 * | 9/2002 | Mathis | 52/847 |
| 6,530,180 | B2 * | 3/2003 | Edmondson et al. | 52/105 |
| 6,641,893 | B1 * | 11/2003 | Suresh et al. | 428/105 |
| 6,772,572 | B2 * | 8/2004 | Henthorn | 52/847 |
| 7,338,701 | B2 * | 3/2008 | Yokoo et al. | 428/212 |
| 8,561,374 | B2 | 10/2013 | Steinberg | |
| 2003/0115828 | A1 * | 6/2003 | Li | 52/730.7 |
| 2008/0047225 | A1 * | 2/2008 | Kawai et al. | 52/796.1 |
| 2008/0134621 | A1 * | 6/2008 | Haga | 52/737.1 |
| 2009/0205287 | A1 * | 8/2009 | Sauteraud | 52/656.2 |
| 2010/0275551 | A1 * | 11/2010 | Hofmann | 52/847 |
| 2011/0173907 | A1 * | 7/2011 | Katsalidis | 52/236.3 |
| 2011/0302870 | A1 * | 12/2011 | Sawada | 52/653.1 |

* cited by examiner

*Primary Examiner* — Mark Wendell
*Assistant Examiner* — Keith Minter
(74) *Attorney, Agent, or Firm* — Haim M. Factor

(57) ABSTRACT

A system of framework timber construction in a building structure, the system comprising: a plurality of free-standing prefabricated glued laminated modular timber frame members, each timber frame member comprising four studs, the four studs being two posts, each post having a lateral dimension $L_2$ and width $W_P$, and two beams, each beam having a lateral dimension $L_1$ and width $W_B$, each timber frame member further comprising: at least three two-post-two-beam members, each two-post-two-beam member having two posts, two beams, and four joints between respective posts and beams, each of the posts and beams having an elongated rectangular shape defined by respective elongated lengths $L_P$ and $L_B$, and having respective widths $W_P$ and $W_B$, and having a thickness, with the at least three two-post-two-beam members having a crisscross glulam construction; wherein the plurality of free-standing prefabricated glued laminated modular timber frame members are configured to form supporting walls of the building structure.

7 Claims, 8 Drawing Sheets

SYSTEM AND METHOD FOR FREE STANDING PREFABRICATED GLUED LAMINATED MODULAR TIMBER FRAME MEMBERS

This application claims priority from U.S. Provisional Application No. 61/751,950, filed 14 Jan. 2013, whose disclosure is incorporated herein by reference.

FIELD AND BACKGROUND OF THE INVENTION

Embodiments of the current invention are related to a prefabricated modular frame for use in a free-standing and/or lean-to structure, built as a timber framing system, and more particularly to a method and system of framework of load-bearing beams and posts made of prefabricated glued laminated modular timber frame members.

Timber framing and post-and-beam construction is a general term for building with heavy timbers—as opposed to "dimension lumber" such as 2-by-4's. Traditional timber frameworking has been used for erecting structures incorporating heavy, squared-off, and carefully-fitted and joined timbers with secured joints. Forming the framework elements demanded on-site skilled labor.

Modern timber structures often incorporate metal joinery such as gusset plates and bolts. Reference is currently made to FIG. 1, which is a schematic moment diagram showing a moment distribution 5 along a prior art beam 6, supported by prior art posts 7, which are in turn supported on two foundations, indicated as inverted triangles, as known in the art. In the moment diagram, an ordinate 8 represents moment (i.e. units of N-m, or lbf-ft) due to a force (indicated in the figure by an arrow) applied to beam 6, with zero, positive, and negative moment values indicated—all as known in the art.

In prior art methods of constructing post-and-beam structures—the posts and/or beams also referred to as "studs"—joints between posts and beams are designed to have essentially zero moments, as shown schematically in FIG. 1. Such current/prior art methods take into account a "zero moment assumption" to ensure mechanical stability and integrity of plates/bolts, which could otherwise be damaged and/or ripped away at a joint having a moment substantially not equal to zero.

A stud functions to support and/or be integrated into a load-bearing wall. Studs, when incorporated in such a wall, essentially act as a stable frame to which interior and exterior wall coverings, generally not designed to support building loads themselves—and also referred to as "curtain walls"—are attached thereupon. Studs are typically expensive elements, traditionally comprising high quality and expensive wood, and are suitable to bear heavy loads. Used as posts and beams, studs serve as vertical and horizontal members of exterior walls and of interior partitions, such as wall plates and lintels. Studs additionally serve as a nailing base for covering material, inter alia.

Other wood construction has employed a variety of framing methods, also known in the art as "light-frame construction" and "framework construction" methods.

Studs are typically supported on a bottom plate or a foundation sill, herein referred to simply as "foundation". Studs serve to support a top plate, as known in the art. In tall framework construction buildings, studs which comprise a frame are usually augmented by additional posts, especially at corners and/or mid-points of extended walls. Some prior art framework construction methods use light prefabricated elements, which typically serve as walls and ceiling elements and which are integrated into the building at a construction site. A prior art example of an element of a frame-type structure is that of Steinberg (the inventor of the current application) in U.S. Pat. No. 8,561,374, whose disclosure is incorporated by reference.

In most current/prior art buildings utilizing lumber framework, during construction (and sometimes even after building construction) studs and/or frames serving as walls must be additionally supported by diagonal supports to ensure stability, at least during construction. In other words, framework construction walls, as described hereinabove are typically not intrinsically free-standing.

In the specification and claims which follow, the term "free-standing", when used in conjunction with frame construction, is intended to mean studs and/or frames which serve as walls that do not need additional support to ensure stability during construction, as described hereinabove. An integratable framework, which is prefabricated and which could be constructed in a free-standing mode, could greatly reduce on-site labor, requiring only semi-skilled labor, and would reduce labor and material costs and subsequently generally reduce overall building cost.

In the specification and claims which follow, the terms "glulam" and "glued laminated timber" are intended to mean a type of structural timber element known in the art, composed of several layers of dimensional lumber bonded together with durable, moisture-resistant adhesives. A single large elongated glulam structural member is typically fabricated by laminating several layers of lumber, thereby optimizing the structural value of the member. Laminated structural members are used as vertical columns or horizontal beams—i.e. studs. Glulam beams are frequently used in the construction industry in place of conventional wood timber to serve as elements such as: beams; columns; cantilevered supports; and/or trusses to provide structural support and integrity. Glulam beams are structurally more sound and are often less expensive than conventional wood products. Glulam beams and posts could be therefore incorporated in a frame structure described hereinabove to afford additional material cost and construction cost advantages.

There is therefore a need for a system and method of constructing a employing free-standing prefabricated glued laminated modular timber frame members to effectively address the problems and provide benefits described hereinabove.

SUMMARY OF THE INVENTION

According to the teachings of the present invention there is provided a system of framework timber construction in a building structure, the system comprising: a plurality of free-standing prefabricated glued laminated modular timber frame members, each timber frame member comprising four studs, the four studs being two posts, each post having a lateral dimension $L_2$ and width $W_P$, and two beams, each beam having a lateral dimension $L_1$ and width $W_B$, each timber frame member further comprising: at least three two-post-two-beam members, each two-post-two-beam member having two posts, two beams, and four joints between respective posts and beams, each of the posts and beams having an elongated rectangular shape defined by respective elongated lengths $L_P$ and $L_B$, and having respective widths $W_P$ and $W_B$, and having a thickness, with the at least three two-post-two-beam members having a crisscross glulam construction; wherein the plurality of free-standing prefabricated glued laminated modular timber frame members are configured to form supporting walls of the building structure.

Preferably, the at least three two post-two-beam members having a crisscross glulam construction are chosen from a list including: series members and parallel members. Most preferably, the posts and beams are formed of wood, the wood grain of the posts being aligned substantially in the direction of elongated length $L_P$ and the wood grain of the beams being aligned substantially in the direction of elongated length $L_B$. Typically, lateral dimension $L_2$ is substantially less than 192 inches, lateral dimension $L_1$ is substantially less than 156 inches, $W_B$ is substantially 4 inches, and the thickness is substantially less than 5 inches. Most typically, lateral dimension $L_2$ is substantially 96 inches, width $W_P$ is substantially 4 inches, lateral dimension $L_1$ is substantially 96 inches, width $W_B$ is substantially 4 inches, and the thickness is 4 inches.

According to the teachings of the present invention there is further provided a method of fabricating a plurality of free-standing prefabricated glued laminated modular timber frame members for a building structure, the method comprising the steps of: determining dimensions, orientation, design limits, and a total number of the plurality of free-standing prefabricated glued laminated modular timber frame members; determining a number "n" for the total number of two-post-two-beam-members comprising each of the plurality of free-standing prefabricated glued laminated modular timber frame members and determining whether series or parallel members are used to form each of the plurality of free-standing prefabricated glued laminated timber frame members; building "n" two-post-two-beam-members for each of the plurality of free-standing prefabricated glued laminated timber frame members; arranging alternately each of the "n" two-post-two-beam-members for each of the plurality of free-standing prefabricated glued laminated timber frame members; and forming each of the plurality of free standing prefabricated glued laminated timber frame members in a crisscross configuration using glulam techniques. Preferably, "n" is at least 3.

BRIEF DESCRIPTION OF THE DRAWINGS

The invention is herein described, by way of example only, with reference to the accompanying drawings, wherein.

DETAILED DESCRIPTION OF THE PREFERRED EMBODIMENTS

Embodiments of the current invention are related to a prefabricated modular frame for use in a freestanding, lean-to structure, built as a timber framing system, and more particularly to a framework of load-bearing beams and columns made of prefabricated glued laminated modular timber frame members.

Figure 1:
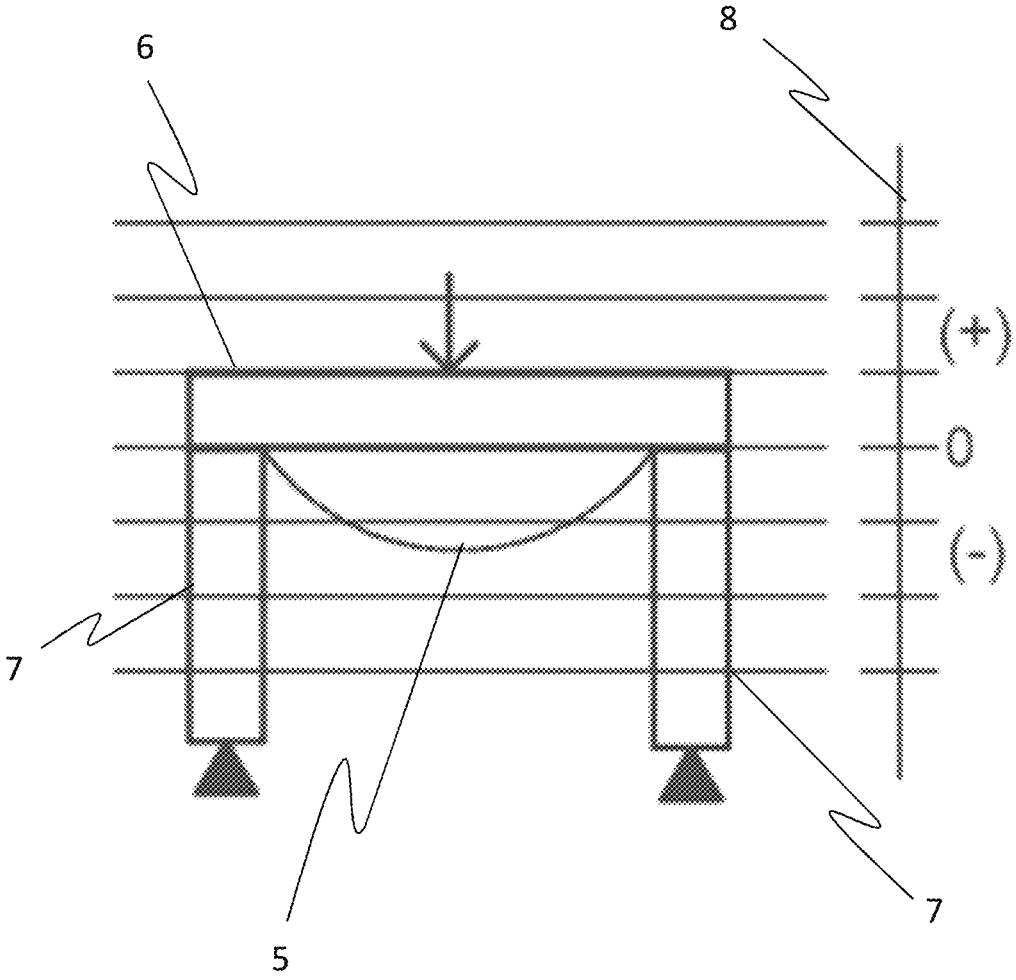
PRIOR ART FIG 1
FIG. 1 is a schematic moment diagram showing a moment distribution along a prior art beam, supported by prior art posts.
Figure 2:
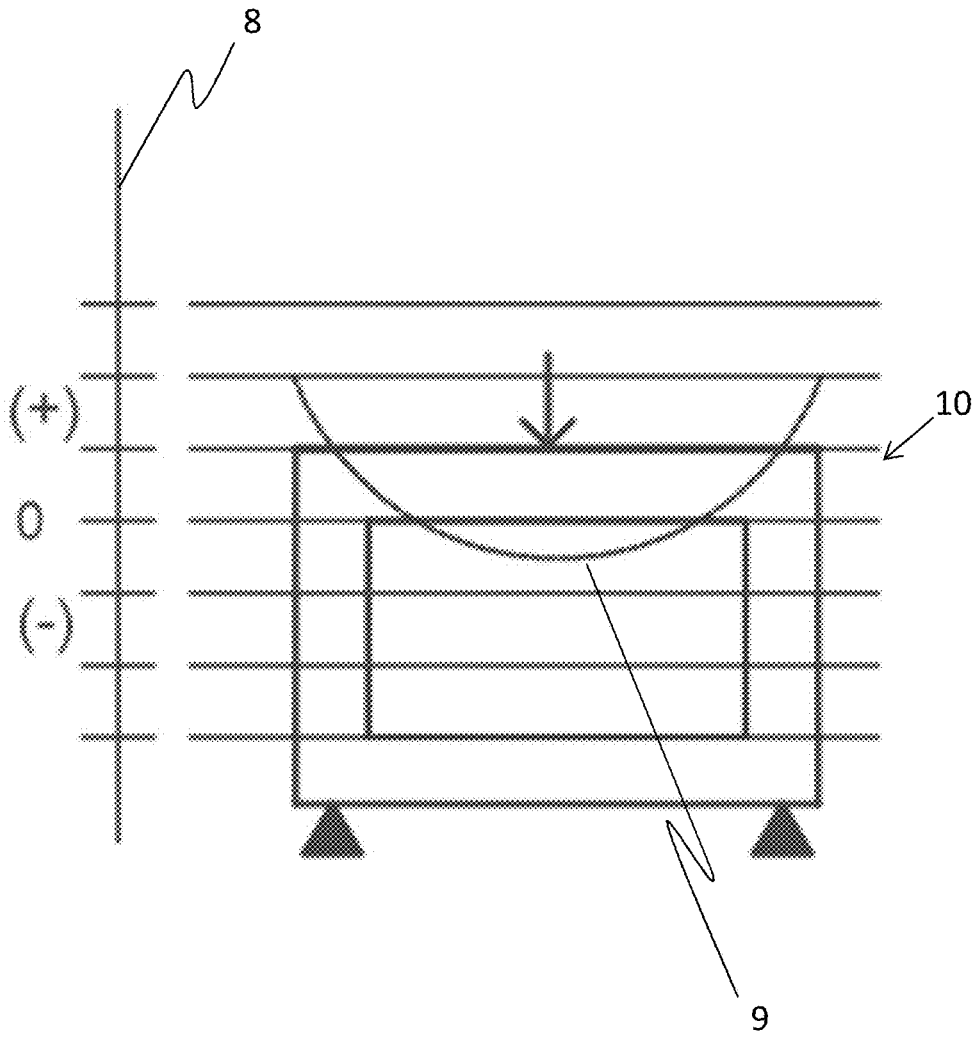
FIG. 2 is a schematic moment diagram, similar to FIG. 1, but showing a moment distribution of a free-standing prefabricated glued laminated modular timber frame member, in accordance with an embodiment of the current invention.

Reference is currently made to FIG. 2, which is a schematic drawing diagram, similar to FIG. 1 (with a force, foundations, ordinate 8, and zero, positive, and negative moment values all indicated—as known in the art) but showing a corresponding moment distribution 9 of a free-standing prefabricated glued laminated modular timber frame member 10, in accordance with an embodiment of the current invention. Moment distribution 9 can be seen in the present figure as being substantially not zero at a position of timber frame member 10 corresponding to the joints between the post and the beam of FIG. 1. Free-standing prefabricated glued laminated modular timber frame member 10 is described in more detail in subsequent figures hereinbelow.

Reference is currently made to FIGS. 3A, 3B, 3C, 4A, 4B, and 4C, which are pictorial drawings of a free-standing prefabricated glued laminated modular timber frame member 20 (FIGS. 3A-C) and a free-standing prefabricated glued laminated modular timber frame member 30 (FIGS. 4A-C), respectively, in accordance with embodiments of the current invention. Apart from differences described hereinbelow, prefabricated glued laminated modular timber frame members 20 and 30 are identical in notation, configuration, and functionality to that described and shown of free-standing prefabricated glued laminated modular timber frame member 10 in FIG. 2 hereinabove.

Figure 3A:
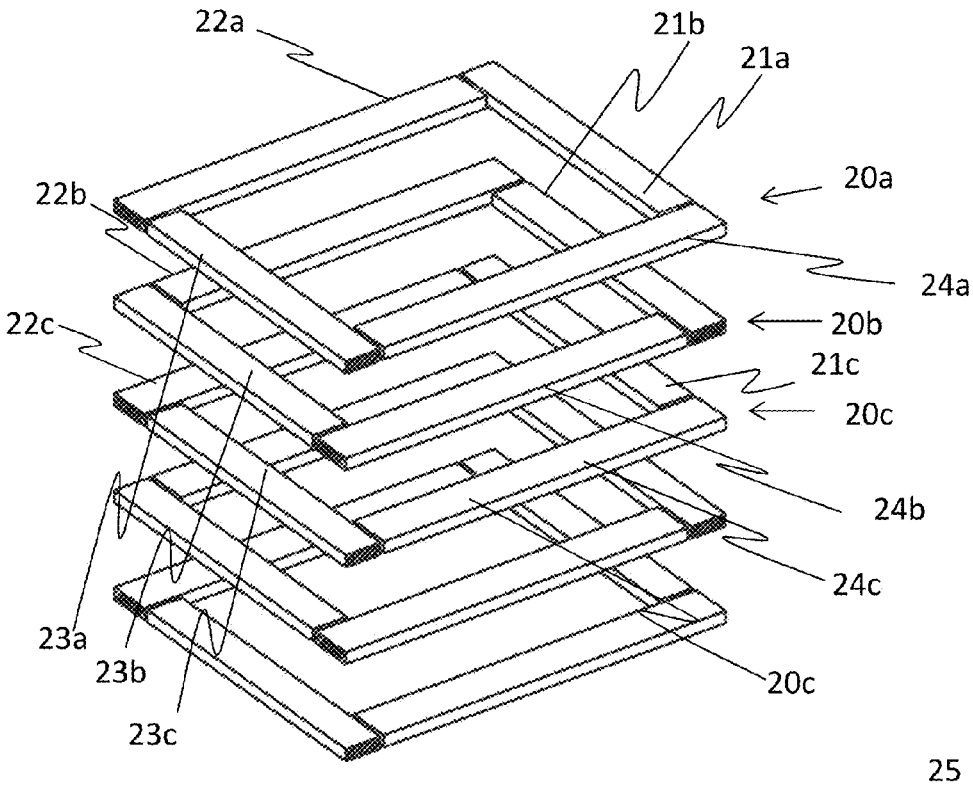
FIGS. 3A, 3B, and 3C are pictorial drawings showing a structure of at least three series two post-two beam members of the free-standing prefabricated glued laminated modular timber frame member of FIG. 2, in accordance with embodiments of the current invention.
Figure 3B:
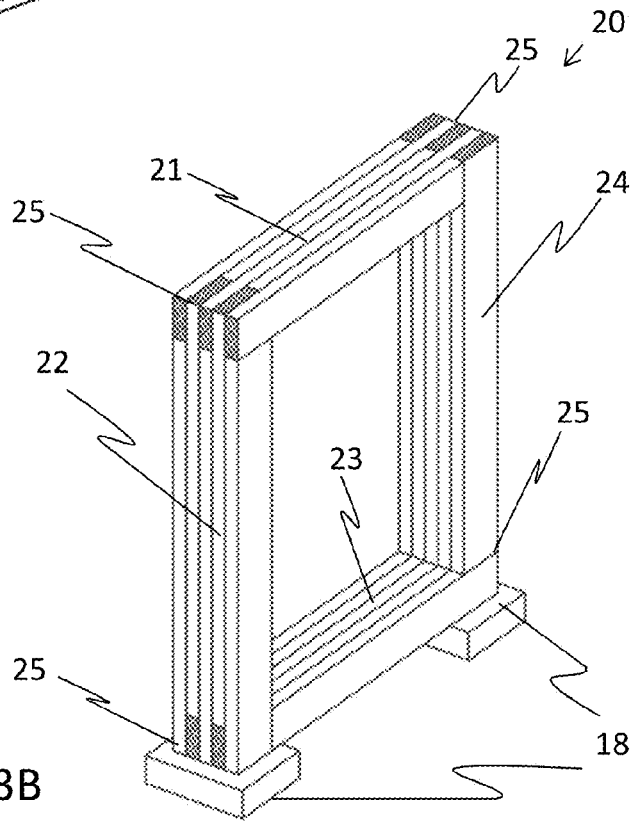
Figure 3C:
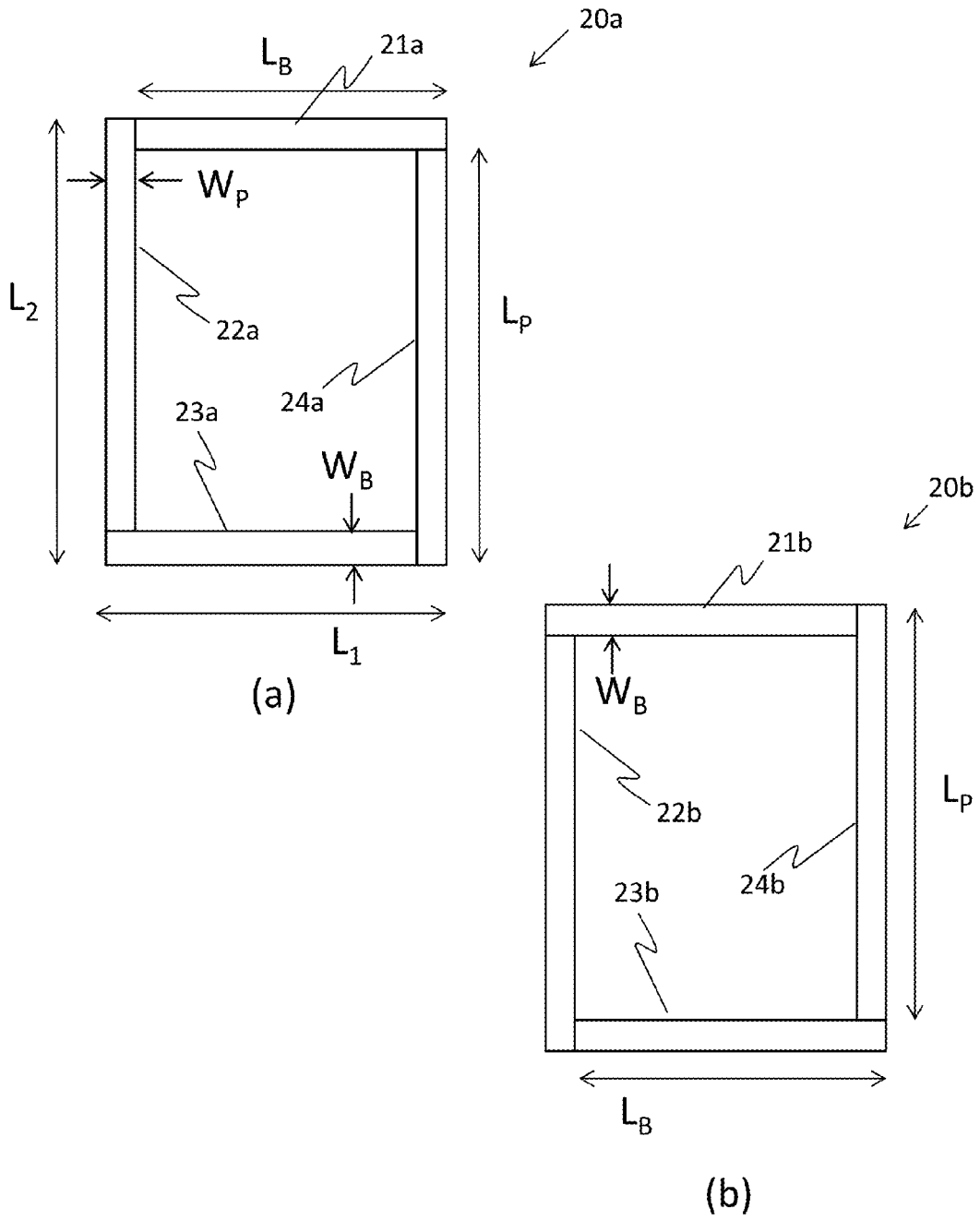

Referring to FIGS. 3A-C, free-standing prefabricated glued laminated modular timber frame member 20 comprises at least three exemplary series two-post-two-beam members 20*a*, 20*b*, and 20*c*, which are formed and subsequently laminated together, as described hereinbelow, forming laminated beams 21 and 23 and laminated posts 22 and 24, and having four joints 25. (Laminated beams 21 and 23 and laminated posts 22 and 24 are collectively called "studs".) Free-standing prefabricated glued laminated modular timber frame member 20 has a rectangular or square shape, having lateral dimensions $L_1$ and $L_2$, as shown in FIG. 3C.

Series member 20*a* is constructed of beams 21*a* and 23*a* and posts 22*a* and 24*a*. The posts and beams are all shown facially (i.e. in length and in width, but without showing a thickness) in the FIG. 3C. The posts and beams have an elongated rectangular shape, defined by an elongated length $L_P$ and $L_B$, respectively, and a width $W_P$ and $W_B$, respectively. The thickness of posts and beams (thickness not shown in the figure) is substantially equal. The posts and beams are formed of wood with the wood grain of the posts and beams aligned substantially in the direction of lengths $L_P$ and $L_B$.

Series member 20*a* is formed by facially arranging beams 21*a* and 23*a* substantially parallel to each other and by facially arranging posts 22*a* and 24*a* substantially parallel to each other and substantially perpendicular to beams 21*a* and 23*a*. As can be seen in FIG. 3C, view (a), beam 21*a* abuts post 22*a*, creating a substantially continuous lateral edge, which includes width $W_P$ of post 22*a* and length $L_B$ of beam 21*a*, the continuous lateral edge having a total length of lateral dimension $L_1$. In similar fashion, post 22*a* abuts beam 23*a*, creating a substantially continuous lateral edge, which includes width $W_B$ of beam 23*a* and length $L_P$ of post 22*a*, with the continuous lateral edge having a total length of lateral dimension $L_2$. In similar fashion, beam 23*a* abuts post 24*a*, creating a substantially continuous lateral edge, which includes width $W_P$ of post 24*a* and length $L_B$ of beam 23*a*, with the continuous lateral edge having a total length of lateral dimension $L_1$. Finally, post 24*a* abuts beam 21*a*, creating a substantially continuous lateral edge, which includes width $W_B$ of beam 21*a* and length $L_P$ of post 24*a*, with the continuous lateral edge having a total length of lateral dimension $L_2$. Beams and posts in series member 20*a* are joined by Glulam techniques, as known in the art, or alternatively by other fastening methods, to create a joint (not identified in the figure), which is mechanically firm and stable.

Series member 20*b* is constructed of beam 21*b*, post 22*b*, beam 23*b*, and post 24*b*, and is formed in similar fashion as described hereinabove for series member 20*a*. Dimensions $L_1$, $L_2$, $L_B$, $L_P$, $W_P$, $W_B$, and the thickness are substantially identical for series member 20*b* as those indicated for series member 20*a* hereinabove.

Series member 20*b* is formed by facially arranging beams 21*b* and 23*b* substantially parallel to each other and by facially arranging posts 22*b* and 24*b* substantially parallel to each other and substantially perpendicular to beams 21*b* and 23*b*. As can be seen in FIG. 3C, view (b), beam 21*b* abuts post 22*b*, creating a substantially continuous lateral edge, which includes width $W_P$ of post 22*b* and length $L_B$ of beam 21*b*, with the continuous lateral edge having a total length of lateral dimension $L_1$. In similar fashion, post 22*b* abuts beam 23*b*, creating a substantially continuous lateral edge, which includes width $W_B$ of beam 23*b* and length $L_P$ of post 22*b*, with the continuous lateral edge having a total length of lateral dimension $L_2$. In similar fashion, beam 23*b* abuts post 24*b*, creating a substantially continuous lateral edge, which includes width $W_P$ of post 24*b* and length $L_B$ of beam 23*b*, with the continuous lateral edge having a total length of lateral dimension $L_1$. Finally, post 24*b* abuts beam 21*b*, creating a substantially continuous lateral edge, which includes width $W_B$ of beam 21*b* and length $L_P$ of post 24*b*, with the continuous lateral edge having a total length of lateral dimension $L_2$. Beams and posts in series member 20*b* are similarly joined by Glulam techniques, as known in the art, or alternatively by other fastening methods, to create a joint (not identified in the figure), which is mechanically firm and stable.

Series member 20*c* is formed identically to series member 20*a*. Referring to FIGS. 3A and 3B, subsequent series members of free-standing prefabricated glued laminated modular timber frame member 20 have alternating configurations of series members 20*a* and 20*b*, as described hereinabove. Alternatively or optionally, standing prefabricated glued laminated modular timber frame member 20 comprises at least 3 series members having alternating configurations of series members 20*b* and 20*a*, as described hereinabove.

Alternating series members are then facially joined using glulam techniques, as known in the art, to create glued laminated modular timber frame member 20. Joints 25 have a resultant alternating or "crisscross" configuration—as can be seen in FIG. 3B. In the specification and claims which follow, the term "crisscross" is intended to mean a glulam construction of alternating members in joints 25 and of laminated modular timber frame member 20—as described hereinabove.

Figure 4A:
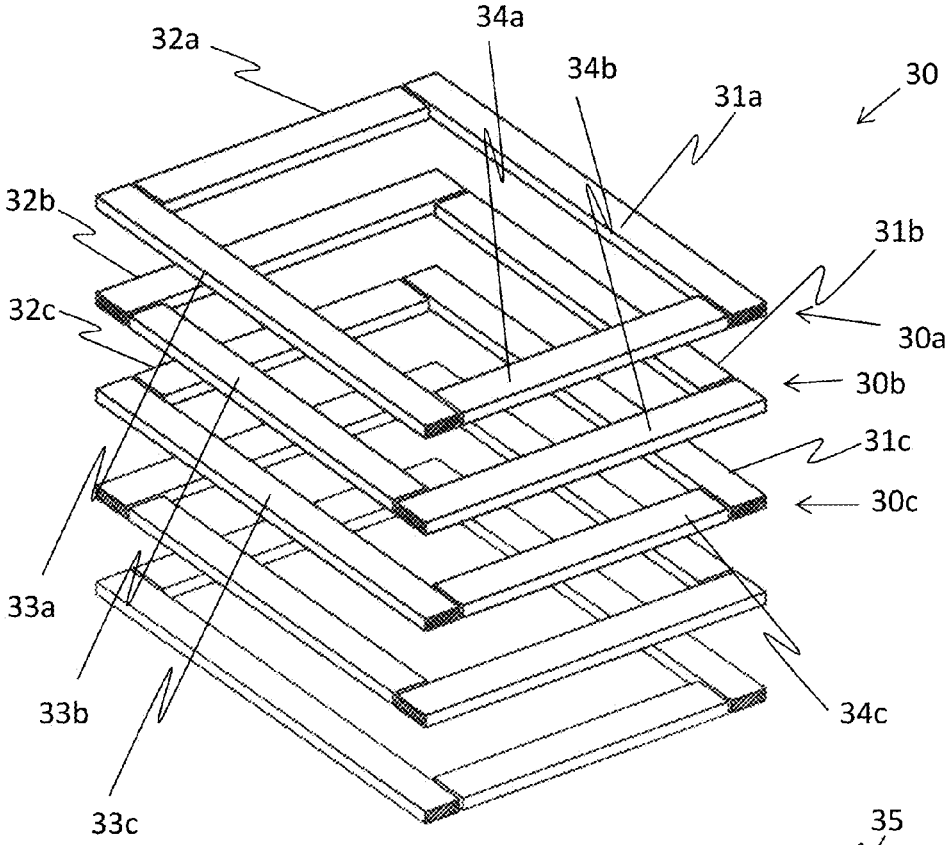
FIGS. 4A, 4B, and 4C are pictorial drawings showing a structure of at least three parallel two post-two beam members of the free-standing prefabricated glued laminated modular timber frame member of FIG. 2.
Figure 4B:
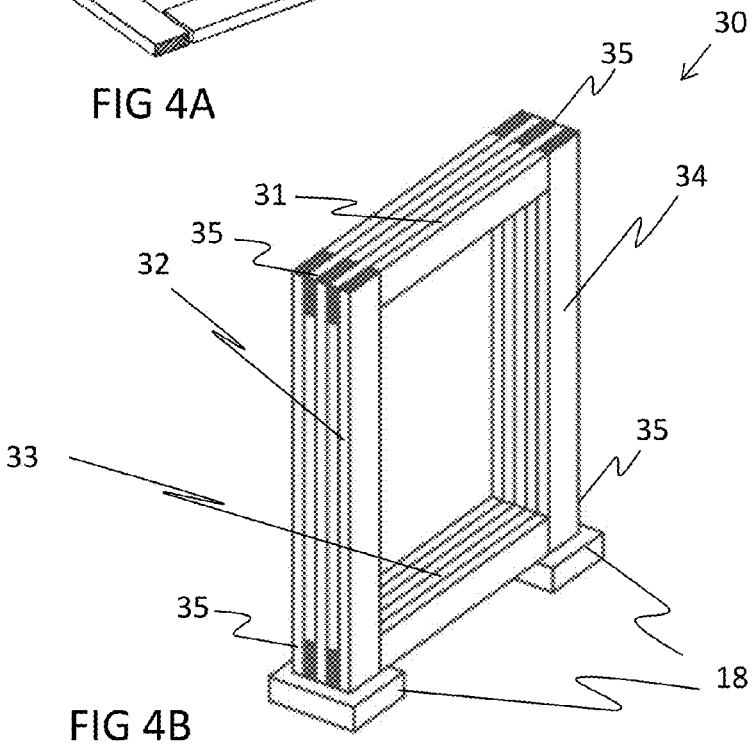
Figure 4C:
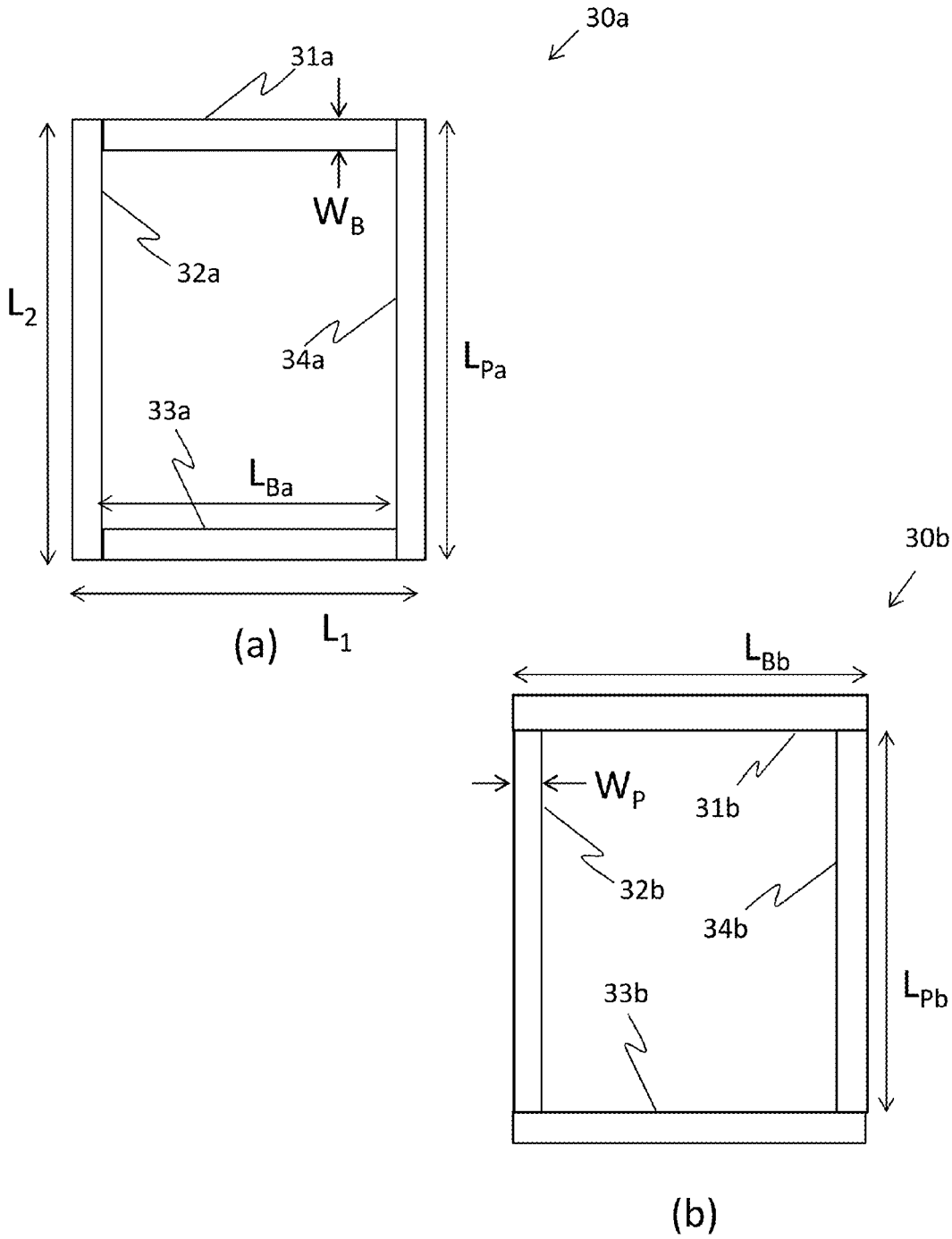

Referring to FIGS. 4A-C, free-standing prefabricated glued laminated modular timber frame member 30 comprises at least three exemplary parallel two-post-two-beam members 30*a*, 30*b*, and 30*c*, which are formed and subsequently laminated together, as described hereinbelow, forming laminated beams 31 and 33 and laminated posts 32 and 34, and having four joints 35. (Laminated beams 31 and 33 and laminated posts 32 and 34 are collectively called "studs".) Free-standing prefabricated glued laminated modular timber frame member 30 has a rectangular or square shape, having lateral dimensions $L_1$ and $L_2$, as shown in FIG. 4C.

Parallel member 30*a* is constructed of beams 31*a* and 33*a* and posts 32*a* and 34*a*. The posts and beams are all shown facially (i.e. in length and in width, with thickness not shown) in FIG. 4C. The posts and beams have an elongated rectangular shape, defined by an elongated length $L_P$ and $L_B$, respectively, and a width $W_P$ and $W_B$, respectively. A thickness of posts and beams (thickness not shown in the figure) is substantially equal. The posts and beams are formed of wood with the wood grain of the posts and beams aligned substantially in the direction of lengths $L_P$ and $L_B$.

Series member 30*a* is formed by facially arranging beams 31*a* and 33*a* substantially parallel to each other and by facially arranging posts 32*a* and 34*a* substantially parallel to each other and substantially perpendicular to beams 31*a* and 33*a*. As can be seen in FIG. 4C, view (a), beam 31*a* abuts posts 32*a* and 34*a*, creating a substantially continuous lateral edge, which includes widths $W_P$ of posts 32*a* and 34*a* and length $L_{Ba}$ of beam 31*a*, with the continuous lateral edge having a total length of lateral dimension $L_1$. In similar fashion, beam 33*a* abuts posts 32*a* and 34*a*, creating a substantially continuous lateral edge, which includes widths $W_P$ of posts 32*a* and 34*a* and length $L_{Ba}$ of beam 31*a*, with the continuous lateral edge having a total length of lateral dimension $L_1$. Posts 32*a* and 34*a* each have length $L_{pa}$ equal to lateral dimension $L_2$.

Beams and posts in parallel member 30*a* are joined by Glulam techniques, as known in the art, or alternatively by other fastening methods, to create a joint (not identified in the figure), which is mechanically firm and stable.

Parallel member 30*b* is constructed of beam 31*b*, post 32*b*, beam 33*b*, and post 34*b*, and is formed in similar fashion as described hereinabove for series member 30*a*, except for differences noted hereinbelow. Dimensions $L_1$, $L_2$, $W_P$, $W_B$, and the thickness are substantially identical for parallel member 30*b* as those indicated for parallel member 30*a* hereinabove. Dimensions $L_{Bb}$, $L_{Pb}$ are introduced (in place of $L_{Ba}$, $L_{Pa}$ for parallel member 30*a* hereinabove) and are described further hereinbelow.

Parallel member 30*b* is formed by facially arranging beams 31*b* and 33*b* substantially parallel to each other and by facially arranging posts 32*b* and 34*b* substantially parallel to each other and substantially perpendicular to beams 31*b* and 33*b*. As can be seen in FIG. 3C, view (b), post 32*b* abuts beams 31*b* and 33*b*, creating a substantially continuous lateral edge, which includes widths $W_B$ of beams 31*b* and 33*b* and length $L_{Pb}$ of beam 32*b*, with the continuous lateral edge having a total length of lateral dimension $L_2$. In similar fashion, post 34*b* abuts beams 31*b* and 33*b*, creating a substantially continuous lateral edge, which includes widths $W_B$ of beams 31*b* and 33*b* and length $L_{Pb}$ of post 34*b*, with the continuous lateral edge having a total length of lateral dimension $L_2$. Beams 31*b* and 33*b* each have length $L_{Bb}$ equal to lateral dimension $L_1$.

Beams and posts in parallel member 30*b* are joined by Glulam techniques, as known in the art, or alternatively by other fastening methods, to create a joint (not identified in the figure), which is mechanically firm and stable.

Parallel member 30*c* is formed identically to parallel member 30*a*. Referring to FIGS. 4A and 4B, it can be seen that free-standing prefabricated glued laminated modular timber frame member 30 comprises parallel members having alternating configurations of parallel members 30*a* and 30*b* described hereinabove. Alternatively or optionally, free-standing prefabricated glued laminated modular timber frame member 30 comprises parallel members having alternating configurations of parallel members 30*b* and 30*a*, as described hereinabove.

Alternating parallel members are then facially joined using glulam techniques, as known in the art, to create glued laminated modular timber frame member 30. Joints 35 have a resultant alternating or "crisscross" configuration—as can be seen in FIG. 4B. In the specification and claims which follow, the term "crisscross" is intended to mean a glulam construction of alternating members in joints 35 and of laminated modular timber frame member 30—as described hereinabove.

Free-standing prefabricated glued laminated modular timber frames 20 and 30 (subsequently referred to hereinbelow as "free-standing prefabricated glued laminated modular timber frame 10") have a configuration which allows for overall lower moments on the frame and for moments to be transferred at the joints (i.e. joints 25 and 35), therefore fulfilling the definition of free standing hereinabove.

The cross section of studs comprising free standing prefabricated glued laminated modular timber frame 10 is typically smaller to the cross section of prior art studs because overall moments of the free standing prefabricated glued laminated modular timber frame are lower than those of prior art studs. In the free standing prefabricated glued laminated modular timber frame configuration described hereinabove a stud cross section may be defined by the thickness of individual two-post-two-beam members and by the number of two-post-two-beam members (ie 3, 4, 5 . . . ). Stud cross section dimensions, as well as free standing prefabricated glued laminated modular timber frame 10 dimensions are calculated and are scalable according to specific building loads and constraints—as described hereinbelow. Embodiments of the current invention include approximate typical dimensions and approximate ranges of dimensions for the variables defined in the description of FIGS. 3A-C and 4A-C hereinabove of free standing prefabricated glued laminated modular timber frames 20 and 30.

| | Approx. typical | Approx. typical range of dimension (inches) | |
|---|---|---|---|
| Variable | dimension (inches) | minimum (inches) | maximum (inches) |
| $L_1$ | 96 | 96 | 156 |
| $L_2$ | 96 | 48 | 192 |
| $W_P$ | 4 | 4 | 4 |
| $W_B$ | 5 | 4 | 8 |
| thickness | 4 | 4 | 5 |

While the exemplary description of free-standing prefabricated glued laminated modular timber frame members 10 hereinabove shows three two-post-two-beam-members, embodiments of the current invention include a minimum of three two-post-two-beam-members and additional two-post-two-beam-members (i.e. 4, 5, 6 . . . ) may be employed. Alternatively or optionally, embodiments of the current invention can employ free-standing prefabricated glued laminated modular timber frame members 20 and 30 (i.e. series and parallel structures) in the same building structure.

Figure 5:
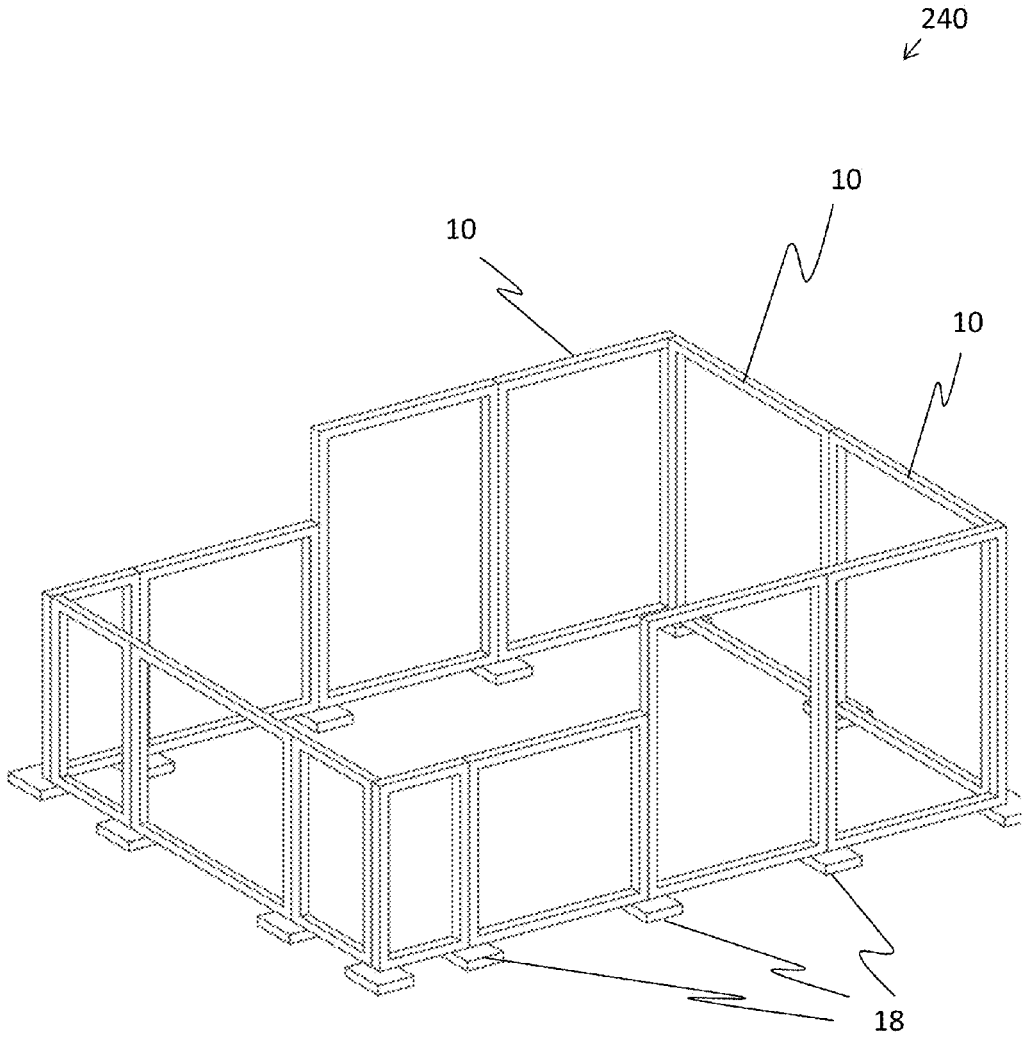
FIG. 5 is a pictorial drawing of a timber frame structure employing a plurality of free-standing prefabricated glued laminated modular timber frame members, in accordance with embodiments of the current invention.

Reference is currently made to FIG. 5, which is a pictorial drawing of a timber frame structure 240 employing a plurality of free-standing prefabricated glued laminated modular timber frame members 10, in accordance with embodiments of the current invention. Apart from differences described hereinbelow, prefabricated glued laminated modular timber frame members 10 are identical in notation, configuration, and functionality to that described and shown of free-standing prefabricated glued laminated modular timber frame members 10, 20, and 30 in figures hereinabove. As indicated in the figure, and as described hereinabove, free-standing prefabricated glued laminated modular timber frame members 10 are shown having various sizes.

Timber frame structure 240 is shown in the present figure as a ground floor having foundations 18 as known in the art. While not shown in the present figure, timber frame structure 240 could alternatively or optionally be a second and/or successive floor supported by a previously constructed supporting structure.

Figure 6:
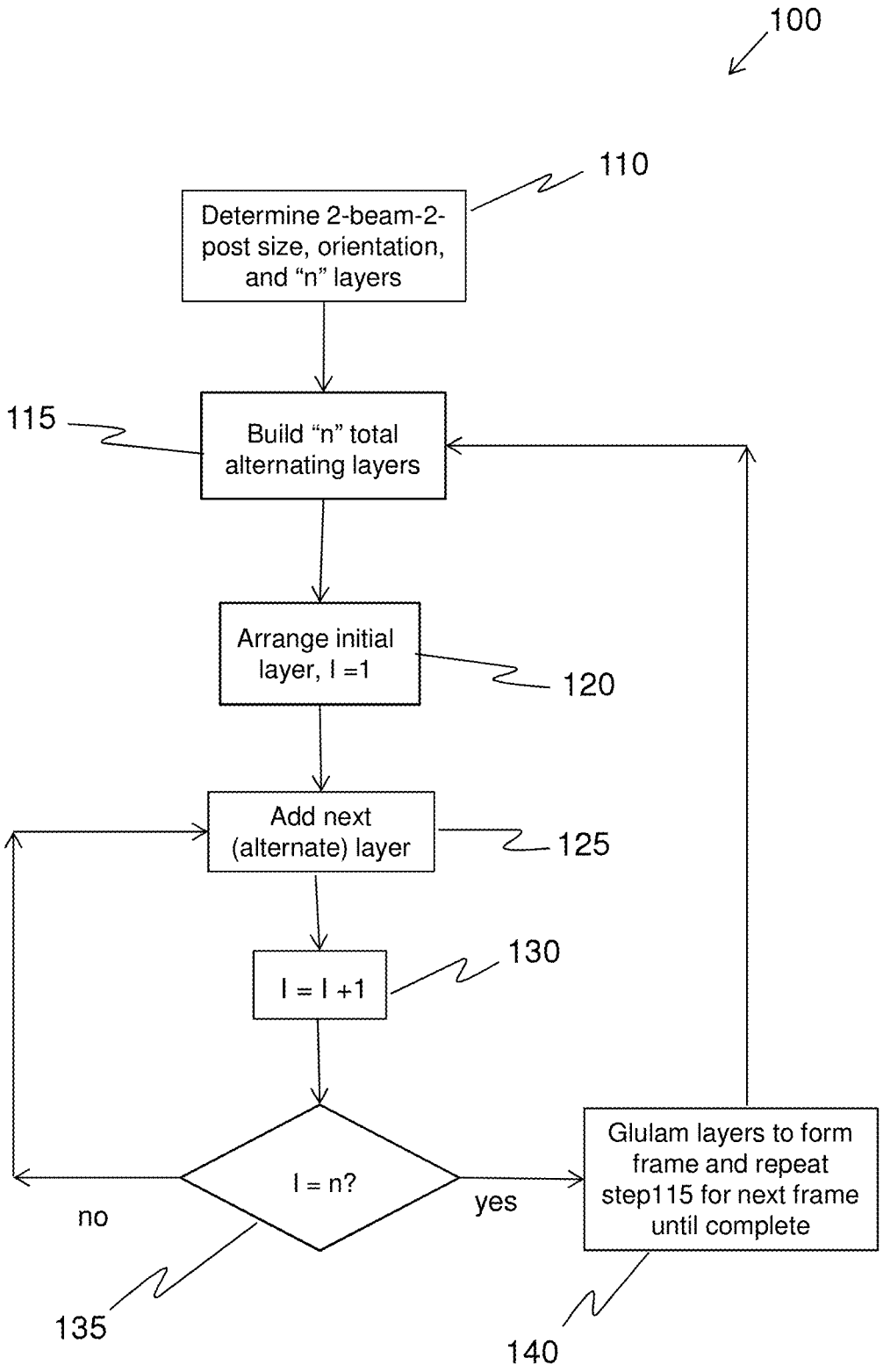
FIG. 6 is a flow chart showing the steps of a method of preparing free-standing prefabricated glued laminated modular timber frame members for the structure of FIG. 5, in accordance with embodiments of the current invention.

Reference is currently made to FIG. 6, which is a flow chart showing the steps of a method 100 of preparing free-standing prefabricated glued laminated modular timber frame members for structure 240 of FIG. 5, in accordance with embodiments of the current invention. Method 100 additionally refers to the detailed description hereinabove of free-standing prefabricated glued laminated modular timber frame members 20 and 30 (ref FIGS. 3A-C and FIGS. 4A-C, respectively), collectively called laminated modular timber frame members 10.

In step 110, "Determine 2-beam-2-post size, orientation, and "n" layers", the dimensions, orientation, and design limits of free-standing prefabricated glued laminated modular timber frame members 10 are determined, as known in the art, for building structure 240. Additionally, the total number of free-standing prefabricated glued laminated modular timber frame members 10 is determined. (By way of example only, the total number of free-standing prefabricated glued laminated modular timber frame members 10 in building structure shown in FIG. 5 is 13.) A number "n", representing the total number of the two-post-two-beam-members for each free-standing prefabricated glued laminated modular timber frame member is determined, where n is equal or greater to 3, as well as whether the prefabricated glued laminated modular timber frame member is formed with series or with parallel members, as described hereinabove.

In step 115, "Build "n" total alternating layers", the "n" alternatingly-configured two-post-two-beam-members in the free-standing prefabricated glued laminated modular timber frame members are constructed, as described hereinabove. In step 120, "Arrange initial layer, I=1", a first two-post-two-beam member is facially oriented (by way of example, such as member 20*a* of FIG. 3B) with additional alternating two-post-two-beam members to be subsequently oriented thereto.

In step 125, "Add next (alternate) layer", the next two-post-two-beam member is facially arranged on the previous two-post-two-beam member, as described hereinabove oriented (by way of example, such as member 20*a* and then member 20*b* of FIG. 3B). In step 130, "I=I+1", a counter I is incremented to count the currently-oriented two-post-two-beam member. In step 135, "I=n?", the counter I is compared with n. If 1 equals n ("yes"), then all of the two-post-two-beam members (meaning at least 3) have been arranged and control is transferred to step 140. If the counter does not equal n ("no") then one or more additional two-post-two-beam members must be arranged, and control is transferred to step 125, "Add next (alternate) layer". At step 140, "Glulam layers to form frame and repeat step 115 for next frame until complete", the current prefabricated glued laminated modular timber frame member is formed by glulam techniques, using the crisscross configuration/arrangement of the two-post-two-beam members of previous steps. Control then reverts to step 115, where the process begins again for the next prefabricated glued laminated modular timber frame member to be formed. Method 100 is complete when the last prefabricated glued laminated modular timber frame member is formed (not indicated in the figure).

Embodiments of the current invention, employing free-standing prefabricated glued laminated modular timber frame members, provide for a prefabricated modular and scalable framework, allowing faster and easier assembly on site compared to prior art methods. The free-standing prefabricated glued laminated modular timber frame members, as described hereinabove, comprise a crisscross construction of glued laminated lumber framing of post and beams in an integrated, load bearing structure. Moreover, embodiments of the current invention provide for a superior moment-bearing joint attachment for posts and beams.

It will be appreciated that the above descriptions are intended only to serve as examples, and that many other embodiments are possible within the scope of the present invention as defined in the appended claims.

The invention claimed is:

1. A system of framework timber construction in a building structure, the system comprising:

a plurality of free-standing prefabricated glued laminated modular timber frame members, each timber frame member comprising four studs, the four studs being two posts, each post having a lateral dimension $L_2$ and width $W_P$, and two beams, each beam having a lateral dimension $L_1$ and width $W_B$, each timber frame member further comprising:

at least three two-post-two-beam members, each two-post-two-beam member having two posts, two beams, and four joints between respective posts and beams, each of the posts and beams having an elongated rectangular shape defined by respective elongated lengths $L_P$ and $L_B$, and having respective widths $W_P$ and $W_B$, and having a thickness, with the at least three two-post-two-beam members having a crisscross glulam construction;

wherein the plurality of free-standing prefabricated glued laminated modular timber frame members are configured to form supporting walls of the building structure.

2. The system of claim 1, wherein the at least three two post-two-beam members having a crisscross glulam construction are chosen from a list including: series members and parallel members.

3. The system of claim 2, wherein the posts and beams are formed of wood, the wood grain of the posts being aligned substantially in the direction of elongated length $L_P$ and the wood grain of the beams being aligned substantially in the direction of elongated length $L_B$.

4. The system of claim 3, wherein lateral dimension $L_2$ is substantially less than 192 inches, lateral dimension $L_1$ is substantially less than 156 inches, $W_B$ is substantially 4 inches, and the thickness is substantially less than 5 inches.

5. The system of claim 3, wherein lateral dimension $L_2$ is substantially 96 inches, width $W_P$ is substantially 4 inches, lateral dimension $L_1$ is substantially 96 inches, width $W_B$ is substantially 4 inches, and the thickness is 4 inches.

6. A method of fabricating a plurality of free-standing prefabricated glued laminated modular timber frame members for a building structure, the method comprising the steps of:

determining dimensions, orientation, design limits, and a total number of the plurality of free-standing prefabricated glued laminated modular timber frame members;

determining a number "n" for the total number of two-post-two-beam-members comprising each of the plurality of free-standing prefabricated glued laminated modular timber frame members and determining whether series or parallel members are used to form each of the plurality of free-standing prefabricated glued laminated timber frame members;

building "n" two-post-two-beam-members for each of the plurality of free-standing prefabricated glued laminated timber frame members;

arranging alternately each of the "n" two-post-two-beam-members for each of the plurality of free-standing prefabricated glued laminated timber frame members; and forming each of the plurality of free standing prefabricated glued laminated timber frame members in a crisscross configuration.

7. The method of claim 6, whereby "n" is at least 3.

* * * * *